United States Patent [19]

Davison

[11] 3,965,541

[45] June 29, 1976

[54] REINFORCING STRAND ANCHORAGE ASSEMBLY

[75] Inventor: John Davison, Harrogate, England

[73] Assignee: CCL Systems Limited, Surbiton, England

[22] Filed: Aug. 13, 1974

[21] Appl. No.: 497,126

[30] Foreign Application Priority Data

Aug. 23, 1973 United Kingdom ..... 39937/73

[52] U.S. Cl. ..... 24/122.6; 52/230; 24/136 R

[51] Int. Cl.[2] ..... F16G 11/04

[58] Field of Search ..... 24/115 M, 122.6, 136 R, 24/81 PE, 263 D; 403/369, 368; 52/230

[56] References Cited

UNITED STATES PATENTS

| | | | |
|---|---|---|---|
| 1,343,426 | 6/1920 | Wright | 24/263 D |
| 1,643,110 | 9/1927 | Briggs | 403/368 |
| 1,832,940 | 11/1931 | Matthes | 24/81 PE |
| 1,909,602 | 5/1933 | Young | 24/263 DT |
| 2,025,556 | 12/1935 | Stahl | 403/369 |
| 2,209,620 | 7/1940 | Berndt | 24/81 PE |
| 2,511,761 | 6/1950 | Barber | 24/136 R |
| 3,327,380 | 6/1967 | Howlett | 403/369 |
| 3,658,296 | 4/1972 | Yegge | 52/230 |
| 3,698,749 | 10/1972 | Yonkers | 403/368 |
| 3,833,706 | 9/1974 | Edwards | 52/230 |

FOREIGN PATENTS OR APPLICATIONS

| | | | |
|---|---|---|---|
| 204,180 | 11/1956 | Australia | 403/374 |
| 218,602 | 10/1958 | Australia | 24/115 X |
| 988,049 | 8/1951 | France | 403/374 |
| 1,373,624 | 8/1964 | France | 403/369 |
| 268,656 | 6/1964 | Netherlands | 52/230 |
| 463,755 | 11/1968 | Switzerland | 24/115 X |
| 894,240 | 4/1962 | United Kingdom | 52/230 |

*Primary Examiner*—Bernard A. Gelak
*Attorney, Agent, or Firm*—Baldwin, Wight & Brown

[57] ABSTRACT

A so-called dead end anchorage assembly for use in prestressing concrete structures which comprises a frusto-conical element received in a correspondingly shaped hole in combination with a stop element fixed to a stressing element to engage one end of said frusto-conical element. Further, said hole has a frusto-conical portion and a cylindrical portion, and the narrow or leading end of said frusto-conical element extends into said cylindrical portion.

5 Claims, 1 Drawing Figure

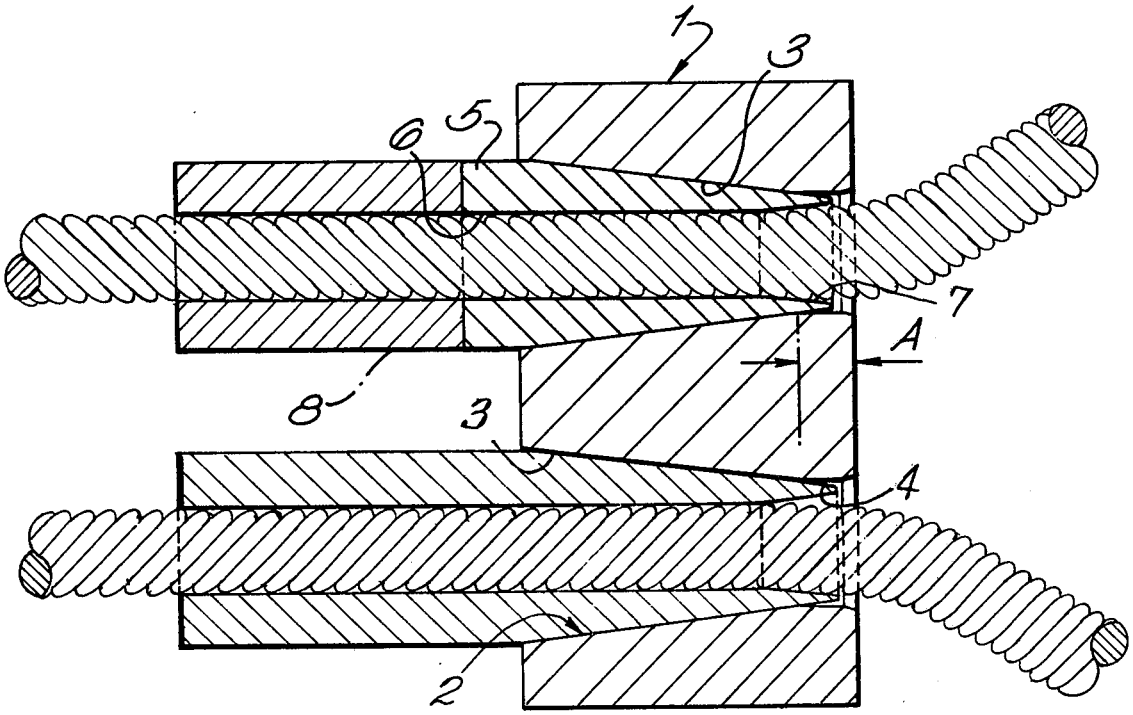
1
3
6
5
7
A
8
3
4
2

REINFORCING STRAND ANCHORAGE ASSEMBLY

This invention relates to an improved anchorage assembly for use in the prestressing of concrete structures and is concerned with a so-called dead end anchorage assembly.

One prior form of dead end anchorage assembly for a multi-strand or wire tendon consists of a compression fitting or other end stop element attached to each strand or wire, the end stop element being arranged to bear against one face of a bearing plate having a plurality of parallel transverse openings through which the strand or wires are passed. The transverse openings are, of necessity, of larger diameter than that of the strand or wire to cater for malformed strand and, during use, large deviation of the strand or wire due to the fact that the area covered by the openings in the bearing plate is greater than the cross-sectional area of the duct in the concrete structure. This arrangement results in breakages at relatively low loads due to the fact that the strand or wire is caused to deviate straight out of the stop element which induces side loading on the strand at a point which is already under high axial tensile and radial compressive loads.

Some improvement in efficiency has been achieved by interposing a seating washer between the stop element and the bearing plate. However, this is still not sufficient to raise the assembly to the present-day requirements of the British Standards Specification No. 4447 and the standards laid down by the Federation Internationale de la Preconstrainte on recommendations and acceptance of post-tensioning systems (1972), concerning the static and dynamic requirements of such anchorages.

Therefore, it is among the objects of the present invention to provide an improved dead end anchorage assembly which reduces the shear loads applied to deviated strands or wires to a minimum.

According to the present invention, there is provided a dead end anchorage assembly comprising a bearing plate having a plurality of transverse frusto-conical openings the axes of which lie parallel to one another and each of which is adapted to receive a strand or wire of a stressing tendon, a frusto-conical element received in each opening to surround the strand or wire, and an end stop element attached to each strand or wire to engage the end of its co-acting frusto-conical element.

The frusto-conical element and the end stop element may be integral with one another and be provided as a single element, or they may be provided as two separate elements.

According to a further feature of the invention, the transverse openings in the bearing plate are each in the form of a frusto-conical portion and a cylindrical portion arranged in continuation thereof, and the relative sizes of each opening and its co-acting frusto-conical element are such that the leading or narrow end of the frusto-conical element extends into the cylindrical portion of the opening.

Thus, it will be appreciated, that any deviation in the strand or wire will occur in the vicinity of the leading end of the frusto-conical element and not in the vicinity of the front end of the end stop element as was the case in the prior art arrangement.

The invention is illustrated by way of example in the accompanying drawing which shows a cross-section through part of an anchorage assembly according to the invention.

Referring to the drawing, there is shown a bearing plate 1 having a plurality of transverse openings 2 each consisting of a frusto-conical portion 3 extending over a major part of the thickness of the bearing plate 1 and a cylindrical portion 4 extending over the remainder of said thickness which is indicated by the arrows A. The axes of the openings 2 are parallel with one another.

Each opening 2 has received therein a frusto-conical element 5 having a central axial bore 6 in which a strand or wire 9 is received, the leading or narrow end of said element 5 being internally tapered at 7 to provide angular relief and being such that it extends into the cylindrical part 4 of the opening 2.

The end of the strand or wire 9 is provided with an end stop element 8, which may be in the form of a compression fitting as described and illustrated in our prior British Pat. Specification No. 1,216,343, one end of the stop element 8 being in engagement with the trailing or wide end of the element 5.

The bore 6 is of smaller diameter than the bore provided in the bearing plate of the prior art anchorage since it is possible, in use, to twist the element 5 as it is being fitted over the ends of the strand thereby enabling the wires forming the strand to be compressed to a smaller diameter. After threading the element 5 over the strand, the end stop 8 is provided on the end of the strand and serves, when the strand is under tension, to hold the element 5 firmly in the opening 2 in which it is a snug fit.

The action of the element 5 is to cause the strand to leave the end stop 8 axially rather than at an angle. Furthermore, the point of deviation is then transferred to the leading end of the element 5 which is disposed in the cylindrical portion 4 of the opening 2 and is, at least initially, unsupported by the wall of the latter. Therefore, the unsupported end will collapse under the action of the deviated strand and will tend to spread the radial load round say half of the strand and at the same time cause the strand to pass over a gentle curved surface thereby reducing the compressive radial stresses.

The use of the frusto-conical element 5 as described will also achieve the objects set out in our co-pending U.S. Patent Application Ser. No. 497,125, filed Aug. 13, 1974, concerning a live anchorage. Thus, the present invention reduces to a minimum the effects of side loading on the strands due, in use, to deviation of the strands between the bearing plate and the tendon duct of the concrete structure.

Although the invention is not limited in this respect it is preferred that the leading or narrow end of the element 5 should extend into the cylindrical portion 4 by a minimum of 5% of the strand diameter.

What we claim is:

1. A deadend anchorage assembly for prestressed concrete structures, comprising an integral bearing plate having substantially planar end wall and a plurality of transverse openings having parallel axes with each of said openings extending through said planar end wall being adapted to receive a stranded stressing element, and each of said openings, in the position of use in a stressed concrete structure, lying at an angle to the axis of its co-acting stressing element at the point where said stressing element extends out of said bearing plate planar end wall, a frusto-conical wedge device having an axial bore and being positioned between the wall of each of said openings and its co-acting stressing element, each of said openings being in the form of a frusto-conical portion and a cylindrical portion arranged in continuation thereof, said frusto-conical portion forming a major part of the length of said opening and said cylindrical portions of said openings being closely adjacent said end wall, and the relative sizes of each of said openings and its co-acting wedge device being such that the leading or narrow end of said wedge device extends into said cylindrical portion of said opening free of contact therewith, said frusto-conical wedge device bore being of a size to freely receive an intended stressing element, and there being an end stop element for attachment to the end of each stressing element and for engaging the enlarged end of its respective frusto-conical wedge device.

2. An assembly as claimed in claim 1, in which said end stop element and said frusto-conical element are provided as a single unit.

3. An assembly as claimed in claim 1, in which said leading or narrow end of said frusto-conical element extends into said cylindrical portion at least a minimum distance equal to 5% of said strand diameter.

4. An assembly as claimed in claim 1, in which that portion of said bore in said leading or narrow end of each frusto-conical wedge member is internally flared.

5. An assembly as recited in claim 4 wherein an extension of said bore flared portion is freely passably through said cylindrical portion to facilitate bending of a stressing element within said bearing plate at least to the extent permitted by said bore flared portion.

* * * * *